US006717027B1

(12) United States Patent
Foster et al.

(10) Patent No.: US 6,717,027 B1
(45) Date of Patent: Apr. 6, 2004

(54) PERSONAL HYGIENE

(75) Inventors: David Graham Foster, Bromley (GB); Ruth Christine Morgan, Horsham (GB); Andrew John Harris, Camberley (GB)

(73) Assignee: Market Migration Limited, Camberley (GB)

( * ) Notice: Subject to any disclaimer, the term of this patent is extended or adjusted under 35 U.S.C. 154(b) by 0 days.

(21) Appl. No.: 09/674,511

(22) PCT Filed: Mar. 15, 2000

(86) PCT No.: PCT/GB00/00961

§ 371 (c)(1),
(2), (4) Date: Nov. 15, 2000

(87) PCT Pub. No.: WO00/54643

PCT Pub. Date: Sep. 21, 2000

(30) Foreign Application Priority Data

Mar. 18, 1999 (GB) ..... 9906285

(51) Int. Cl.[7] ..... A61F 13/15

(52) U.S. Cl. ..... 604/364; 604/367; 604/378; 604/385.31; 428/43; 428/77; 428/78; 428/121; 428/124; 428/125

(58) Field of Search ..... 428/43, 77, 78, 428/121, 124, 125; 604/364, 367, 378, 385.01, 385.13

(56) References Cited

U.S. PATENT DOCUMENTS

| | | | | | |
|---|---|---|---|---|---|
| 2,840,080 | A | * | 6/1958 | Clark | 604/289 |
| 2,999,265 | A | * | 9/1961 | Duane et al. | 424/443 |
| 3,881,210 | A | * | 5/1975 | Drach et al. | 15/104.93 |
| 4,490,147 | A | * | 12/1984 | Pierce et al. | 604/378 |
| 4,582,743 | A | | 4/1986 | Bähring | 428/125 |
| 4,925,453 | A | * | 5/1990 | Kannankeril | 604/378 |
| 4,998,984 | A | * | 3/1991 | McClendon | 206/205 |
| 5,492,746 | A | | 2/1996 | Chang | 428/78 |
| 5,520,672 | A | * | 5/1996 | Urry | 604/368 |
| 5,643,240 | A | * | 7/1997 | Jackson et al. | 604/378 |
| 5,961,500 | A | * | 10/1999 | Weinstein | 604/304 |
| 6,152,905 | A | * | 11/2000 | Osborn et al. | 604/378 |
| 6,322,665 | B1 | * | 11/2001 | Sun et al. | 162/158 |
| 6,413,338 | B1 | * | 7/2002 | DiPalma | 156/73.1 |
| 2001/0047159 | A1 | * | 11/2001 | Mizutani | 604/385.23 |
| 2002/0040213 | A1 | * | 4/2002 | Tweddell, III et al. | 604/385.01 |

FOREIGN PATENT DOCUMENTS

| | | |
|---|---|---|
| DE | 654 246 | 12/1937 |
| DE | 1 939 788 | 6/1966 |
| FR | 1 518 763 | 7/1968 |
| FR | 2 176 247 | 10/1973 |
| GB | 26741 | 11/1910 |

* cited by examiner

*Primary Examiner*—Weilun Lo
*Assistant Examiner*—Michael G. Bogart
(74) *Attorney, Agent, or Firm*—Rothwell, Figg, Ernst & Manbeck, P.C.

(57) ABSTRACT

The present invention provides methods and devices for personal cleaning and, in particular, for cleaning and/or drying following defecation or urination, or for cleaning and freshening during menstruation.

Devices according to the invention are unitary, in the sense that they do not require any configuring or formatting prior to use, and have two distinct zones of varying functional performance, one zone being configured with the principal objective of absorbing and retaining faeces, urine or menses, and the other zone being configured with the principal objective of protecting the user's hand.

The devices drape over the user's hand and can be manipulated into body crevices.

14 Claims, 4 Drawing Sheets

PERSONAL HYGIENE

TECHNICAL FIELD

This invention relates to personal hygiene and has been devised particularly, though not necessarily solely, to provide methods of, and means for, personal cleaning and/or drying following defecation or urination; or for cleaning and freshening by women during menstruation.

BACKGROUND

Humans conventionally use toilet tissue drawn from a roll for cleaning after defecating. Females also use toilet tissue for drying after urinating and for cleaning and freshening during menstruation.

Toilet tissue is essentially a raw material. Whatever the task for which it is used, prior to commencing the cleaning, drying or freshening operation, each individual typically configures a quantity of toilet tissue into a "product" which meets that individual's preference for the task ahead. There tend to be common forms of "product" formed from toilet tissue. A first form is achieved by wrapping paper drawn from the roll about an outstretched hand, primarily to ensure coverage of the fingers. A second form is achieved by folding sections of paper drawn from the roll over each other to provide a pad. This is typically held in position to overlie the fingers and, perhaps, part of the palm of the hand by anchoring a corner or edge of the pad between the thumb and the adjacent edge or side of the palm. The third typical form of product is achieved by drawing paper from a roll into a wad which is then directed or worked into the area to be cleaned or dried principally using the fingertips.

Whatever form of "product" is chosen, our investigations suggest that the consumer is equally concerned with keeping the hand out of contact with the products being cleared away, as with ensuring the cleaning task is being completed effectively.

With the above factors in mind, it is not surprising that, regardless of the configuration of "product" chosen, a substantial proportion of the tissue taken from the roll plays no part in the cleaning or drying function. Further, many of the resulting pads or wads of tissue are quite bulky, are often difficult to flush, and can lead to blockage in sewerage systems.

A number of potential substitutes for conventional toilet tissue have been proposed in the past.

U.S. Pat. No. 3,638,789 describes a disposable, finger-protecting mitt designed for, amongst other things, use in wiping off faecal material. The mitt includes a pad of cotton batting adhered to a thin plastics envelope so as to be positioned over the finger tips when the mitt is in use. A section of the plastics envelope covers the backs of the fingers. This product is intended and configured for use by care givers and is not suitable for mainstream perineal cleaning or drying for a number of reasons. Firstly, the fixed relationship of the pad with respect to the mitt gives the user little or no opportunity to adjust the orientation of the pad with respect to the hand, in use, according to preference. Further, since the envelope is formed from polyethylene plastics sheeting, and the pad from bulky cotton, the device is not suitable for disposal, after use, through conventional disposal systems such as municipal sewerage systems or septic tanks.

European Patent Specification 0 032 793 describes a further form of cleansing article intended and configured for faecal cleaning by care givers. The article described in the patent comprises a high loft, bulky fibrous mat impregnated with an oleaginous cleansing agent. Because of its bulk, this article is clearly not intended to be, or capable of being, worked by normal finger pressure into intimate contact with body crevices. Further, the bulk has clearly been built into the product to enhance the feeling of security to the user but, as a result, the device includes a good deal of material which is superfluous to the cleaning function. Finally, the bulk of the material used, and the high content of synthetic fibres, makes the device unsuitable for disposal through conventional sewerage disposal systems.

U.S. Pat. No. 4,582,743 describes a toilet paper web provided with longitudinal folds so as to provide a longitudinally extending central section which is thicker than the side edges and thus provides a greater strength in the centre of the sheet than conventional tissue. The web is, however, of uniform section in a longitudinal direction, is homogeneous in material composition, and thus still involves wastage of material while not enhancing hand protection, or consumer confidence, through greater area coverage of the hand.

UK Patent application 2,257,036 describes what is referred to as "sanitary dabs" for use by females after urination. While no adequate description is provided, it would appear this application proposes nothing more than a conventional lotion-impregnated wipe.

It is an object of this invention to provide a novel method of, and/or means for personal cleaning and/or drying following defection or urination, or during menstruation, which address the needs and concerns of consumers whilst, at the same time, going at least some way in addressing the shortcomings of the prior art practices and devices described above; or which will at least provide a useful choice.

SUMMARY OF THE INVENTION

Accordingly, in a first aspect, the invention provides a method of personal cleaning and/or drying after defecation, urination, or cleaning during menstruation, said method including the steps of:

(i) taking a cleaning device not requiring configuration before use, said cleaning device being of a size able to overlie the fingers of the user and having a visually distinct area which is greater than the remainder of the device in respect of at least one of the following:
absorbency
tensile strength
thickness
strike through;

(ii) placing said device on the hand so as to overlie the fingers when positioned in edge to edge contact;

(iii) bringing said device, positioned on the hand, into contact with that part of the body from which faeces, urine and/or menses is to be removed;

(iv) displacing said device with respect to the body whilst maintaining contact with the body; and (v) disposing of the used device through a conventional sewerage disposal system.

Preferably said device is brought into contact with the body in a manner such that the area of greatest absorbency of said device is positioned to contact the area of greatest concentration of faeces, urine or menses.

Preferably said device is held on the hand by anchoring an edge part of the device between the thumb and another part of the hand.

In a second aspect the invention provides a method of improving the efficiency of personal cleaning and/or drying after defecation or urination, or cleaning during menstruation, when compared with methods involving the use of tissue drawn from a roll, said method including:

(i) taking a cleaning device not requiring configuration prior to use, being sized to overlie at least the finger area of a user, and having at least one visually distinct area thereon which is greater than the remainder of the device in respect of at least one of the following:
absorbency
tensile strength
thickness
strike through;

(ii) applying said device to the area to be cleaned so that said at least one visually distinct area is brought into contact with urine, faeces or menses to be cleaned from the body; and (iii) after use, disposing of said device through a conventional sewerage system.

Preferably said method further includes positioning said device so that said at least one visible area is positioned over the tips of at least two adjacent fingers.

In a third aspect the invention provides a method of providing for cleaning and/or drying after defecation or urination, or cleaning during menstruation, said method including providing a protective element to protect the user's hand against contact with urine, faeces and/or menses; and providing in unit with said protective element, and in a configuration ready for use, retention means to retain said urine, faeces and/or menses, said retention means having greater properties than said protective element in respect of at least one of the following:

absorbency
tensile strength
thickness
strike through

In a fourth aspect, the invention provides a unitary device for cleaning and/or drying after defecation or urination, or cleaning during menstruation, said device including:

(i) a first zone of an area sufficient in size to overlie the fingers of an intended user;

(ii) a second zone at least partly within said first zone, said second zone being sized and arranged in relation to said first zone so as to be positionable to overlie the tips of at least two fingers whilst said first zone overlies all fingers, said second zone having a higher quantitative measure than said first zone in respect of at least one of the following:
absorbency
tensile strength
thickness
strike-through.

Preferably said second zone has higher measures than said first zone in respect of at least two of the parameters identified in the preceding paragraph.

Preferably said second zone has higher measures than said first zone in respect of three or more of the parameters identified in the penultimate paragraph.

Preferably said device is comprised of materials disposable through conventional sewerage disposal systems.

Preferably said device is configured and sized for gripping by the application of thumb pressure when said second zone is positioned to overlie the tips of at least two fingers. More preferably, said first zone is sized and configured to provide a gripping location.

Preferably said first zone is sized to overlie not only the fingers but also to overlie at least part of the user's palm.

Preferably said second zone is visually distinct from said first zone.

Preferably said second zone is sized to overlie the tips of all fingers when said fingers are positioned in edge to edge contact with one another.

Preferably said second zone has a different material composition from said first zone.

Preferably said first zone is comprised of at least two 1 layers of sheet material combined in a production process into a unitary device.

Preferably said second zone is defined by inserting absorbent filling means between the layers defining said first zone.

Preferably said filling means includes wood-based pulp. Alternatively, or in addition, said filling means may comprise at least one extra web of absorbent material.

Preferably said second zone includes absorbency enhancing agents to enhance the absorbency thereof.

Preferably said absorbency boosting agents are included within said filling means. Said absorbency boosting agents may be dispersed throughout said filling means or may be applied in discreet patches or areas within said filling means.

Preferably devices according to the invention are constructed and arranged to drape over the finger tips when supported horizontally, in the position of user, on a hand.

Particular embodiments of personal use devices according to the invention may further include moistening agents. Said moistening agents may be in the form of liquid cleansing agents. Alternatively, or in addition, said moistening agents may comprise or include perfume. Still further, embodiments of device according to the invention may be used to deliver or apply pharmaceutically active compounds to, or adjacent to, the perineal area.

Preferably said first zone is formed from substantially bio-degradable materials selected from the range of hydro-entangled webs, air-laid tissue, conventional tissue and through-dry tissue, all such materials being of a composition capable of disposal through conventional sewerage disposal systems.

Preferably said first zone has a liquid absorbency falling within the range 250 to 400 Total Water Absorbency (TWA) grams per square meter.

Preferably said second zone has an absorbency falling in the range 1000 to 2500 TWA grams per square meter.

Preferably said first zone is formed from material or materials having different machine direction and cross-machine direction tensile strength characteristics, said first zone having a tensile failure loading in the machine direction (MDT) falling in the range 300 to 1500 gms. The same zone preferably has a tensile failure loading (dry) in the cross machine direction (CDT) of 150 to 1000 gms, both failure loadings being determined by PIRA standard paper testing techniques.

Preferably said second zone has a direction of maximum tensile strength, the tensile failure loading in that direction falling in the range 300 to 1500 gms. Typically the tensile failure loading (dry) in an orthogonal direction falls in the range 150 to 1000 gms, both failure loadings being determined by PIRA standard paper testing techniques.

Preferably said device is constructed so that the cross machine direction of the material defining at least part of said second zone is aligned with the machine direction of the material defining said first zone.

In a fifth aspect the invention provides a device for cleaning and/or drying after defecation or urination, or cleaning during menstruation, said device including a protective element sized and configured to provide protection to a users hand against contact with faeces, urine and/or menses; and retention means in unit with said protective element, said retention means having greater properties than said protective element in respect of at least one of the following:

absorbency tensile strength thickness strike through.

In a sixth aspect the invention provides a unitary device for cleaning and/or drying after defecation or urination, or cleaning during menstruation, said device being sized to overlie and contact the hand of a user and including therein, Absorbency means to attract and retain urine, faeces and /or menses.

Preferably said device is constructed and arranged to conform, at least partially to the contours of the user's hand. Preferably said device is further constructed and arranged to fold about at least part of the user's hand.

Preferably said device includes a combination of different materials having different rates of absorbency.

Many variations in which the present invention may be performed will present themselves to those skilled in the art. The description which follows is intended as an illustration only of how the invention may be performed and the absence of detail or description of particular alternatives should not be interpreted as excluding such alternatives. Wherever possible, a description of particular elements should be interpreted as including mechanical equivalents thereof whether existing now or in the future. The scope of the invention should be determined solely by the appended claims.

BRIEF DESCRIPTION OF THE DRAWINGS

Examples of the invention will now be described with reference to the accompanying drawings in which.

DESCRIPTION OF WORKING EMBODIMENTS

According to the invention described herein, there are provided novel unitary personal use devices for cleaning, drying and/or freshening the anal and/or genital region of a human subject. Typical uses for such devices include cleaning of the anal area after defecation by both males and females; cleaning and freshening of the vaginal area by females during menstruation; and drying of the genital region by females after urination.

The term unitary device, as used herein, means a device which, in its delivered state, is ready for use. The unitary devices covered by this invention can be used immediately without any addition configuration save that, upon being gripped or handled, the devices may, at least to some extent, form themselves into contact with, and around, the user's hand through the natural draping effect of the material(s) from which the devices are formed.

Figure 1:
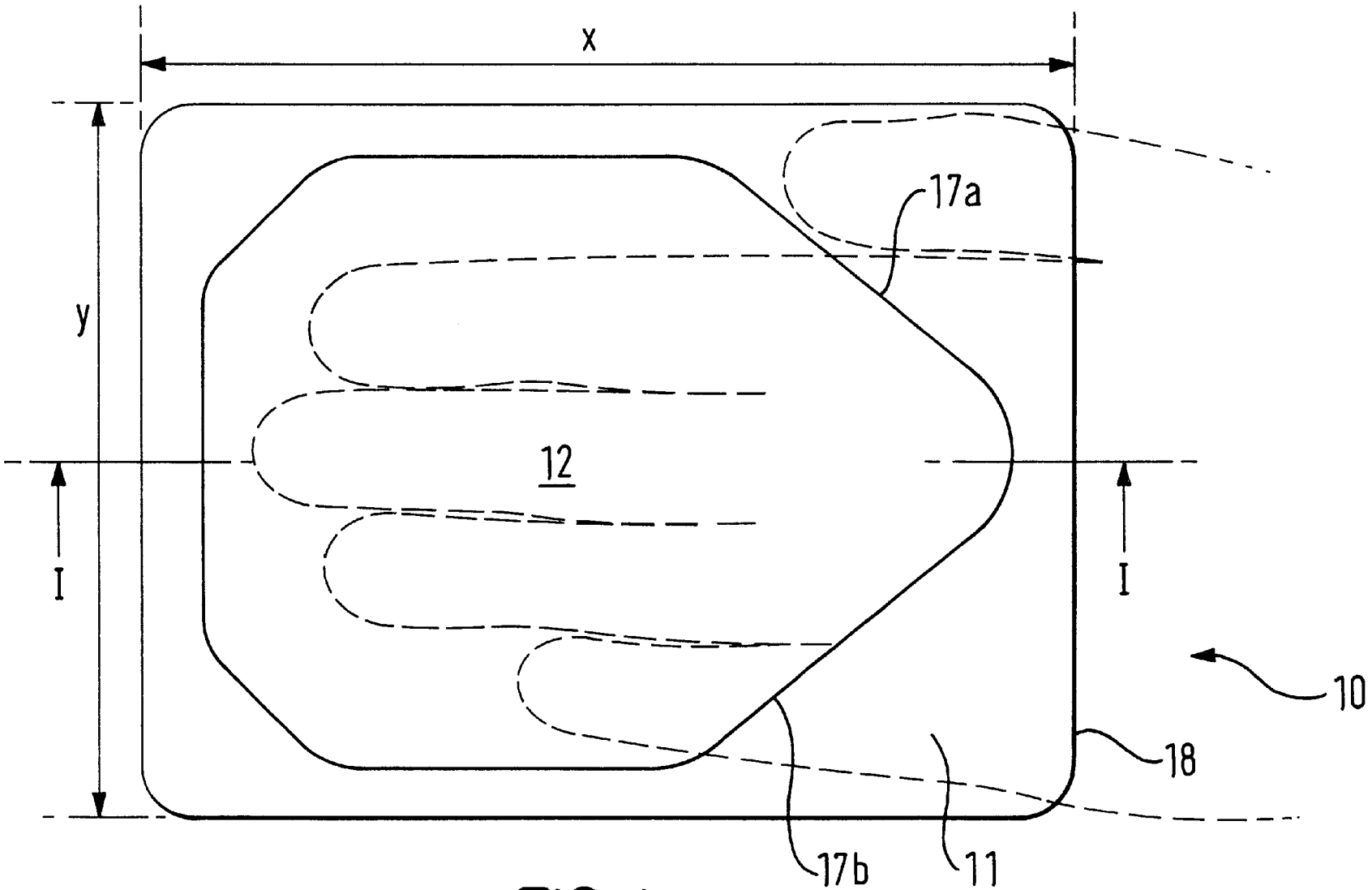
FIG. 1: shows a plan view of a first form of personal use device embodying the invention.
Figure 2:
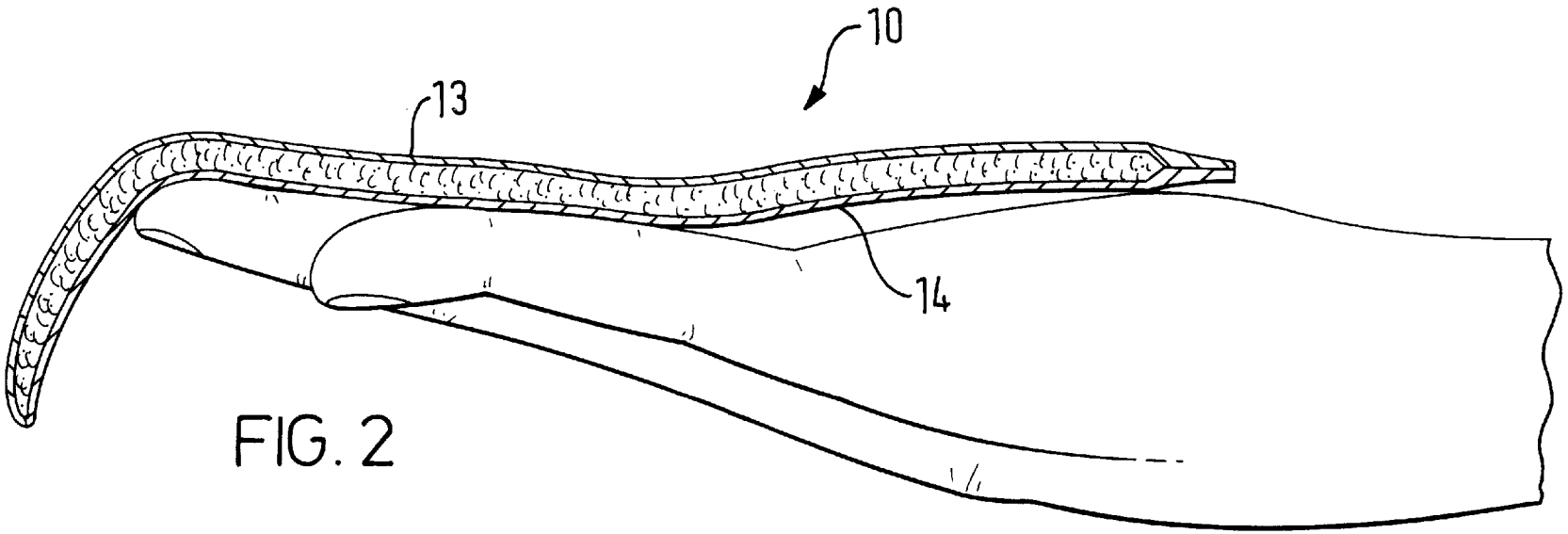
FIG. 2: shows a cross-sectional view along the line I—I in FIG. 1 with the device in place on the upturned hand of a user.

Referring firstly to FIGS. 1 to 4, a pre-configured, unitary, personal use device 10 is shown of substantially rectangular overall shape, the device being shown in FIGS. 1 & 2 in position draped over the upturned hand of a user, in a position ready for use.

As can be seen, the device 10 comprises a first zone or protective element 11 which is sized and configured to overlie at least the fingers of the intended user, and a second zone or retention element 12, positioned at least partly within the first zone 11, the second zone 12 being so configured and positioned in relation to the first zone so that, in use, the second zone 12 can be positioned to overlie the tips of least two fingers whilst the first zone is overlying substantially all parts of all fingers, the hand being configured with all fingers substantially in edge contact. The second zone 12 is also constructed and arranged to provide greater operating performance than the first zone in respect of at least one of the following parameters:

absorbency tensile strength thickness strike-through.

In accordance with particularly preferred embodiments of devices described herein, the second zone has greater operating performance in respect of at least two and preferably all of the listed parameters. Thus, while the first zone 11 will preferably have some characteristics desirable for perineal cleaning and/or drying such as, for example, a degree of absorbency, softness, tensile strength etc, devices according to the invention have been designed so that the first zone 11 serves primarily to provide hand protection whilst the second zone 12 serves primarily to remove and retain faeces, urine and/or menses. Thus devices according to the invention combine the functions of security and cleaning efficiency required by consumers in a pre-formed device delivered ready for use.

In the case of the device shown in FIGS. 1 to 4, the second zone 12 is smaller, in plan area, than the first zone 11. Functionally effective devices in accordance with the invention may also be formed in which the second zone is substantially the same area as the first zone, however there will inevitably be some loss of materials efficiency with such a configuration. In other words, the second zone may have greater absorbency than is required for a particular application.

Figure 5:
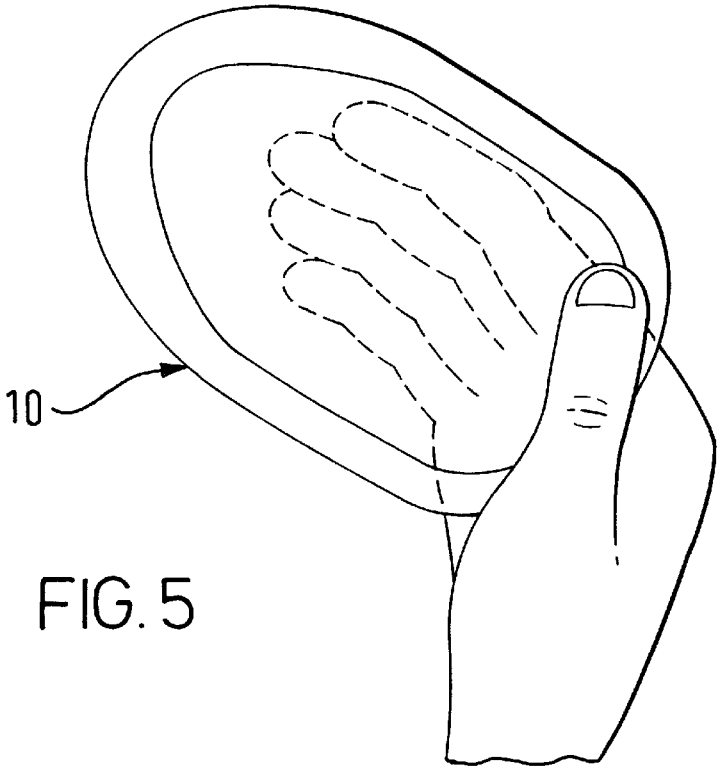
FIG. 5: shows a schematic view of a personal use device as shown in FIGS. 1 to 4 grasped by a user in a position ready for use.

Devices according to the invention may be merely rested on the hand during positioning just prior to use and, during use, probed or manipulated into body contact using pressure applied through the finger tips in the conventional manner. However, it is typical that, at some stage, the user will want to grip the device before, during or after the cleaning operation. With pads formed from conventional toilet tissue, gripping is typically effected by gripping an edge or corner of the pad between thumb and forefinger substantially as shown in FIG. 5. Accordingly, as is shown more clearly in FIG. 5, devices according to the invention are preferably sized and configured for gripping by the application of thumb pressure and, more particularly by trapping between thumb and forefinger. In the embodiments shown and described herein, the first zone 11 provides hand coverage greater than that necessary to overlie the fingers. Thus, the first zone is sized and configured to that part thereof extends, in use, over part or all of the palm and, at least, about one edge of the palm to enable the device to be grasped, as shown in FIG. 5, between thumb and forefinger.

Personal use devices according to the invention may be sized according to intended use. Size may also vary according to sex, age and ethnic origin of the intended or target user. For example, a device intended for all purpose use by adult males and females may well be larger than a device designed particularly for female drying after urination. Anthropometrical data suggests that, for an all purpose adult device, devices for Asian markets may be somewhat smaller than such a device intended for European markets given that adults from Asian regions typically have smaller sized hands. Guidance on sizing can be gained, if desired, from publications such as "Bodyspace" by Stephen Pheasant, Taylor & Francis, 1988.

In a similar manner, a device intended for particular use by younger age groups may be smaller.

For typical European adult (male and female) all purpose use, devices according to the invention, and as depicted in FIGS. 1 to 4, may have an x dimension (FIG. 1) of about 150 mm and a y dimension of about 110 mm.

Final sizing can be determined, if necessary, through consumer testing.

Figure 3:
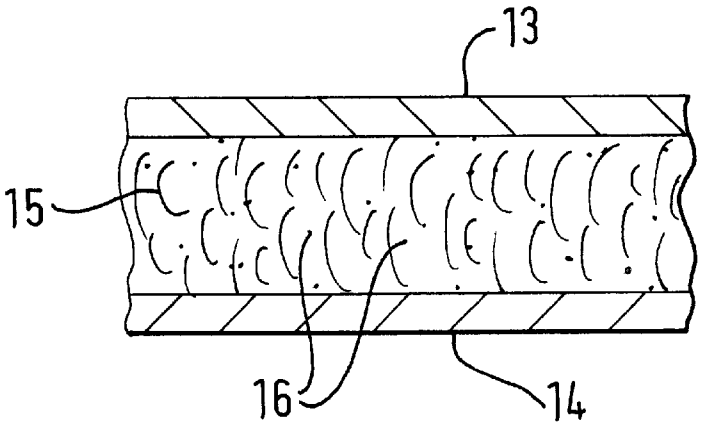
FIG. 3: shows an enlarged view through part of the cross-section of the device shown in FIG. 2.

In the embodiment shown in FIGS. 1 to 3, the first zone is provided by two layers of sheet material 13 and 14 fixed together about the edges thereof. The second zone 12 is defined by a raised, central section formed by inserting an absorbent filler material 15 between the layers 13 and 14.

When viewed in plan, the second zone may have tapered edges 17*a*, 17*b* to place the area of greatest functional performance over the finger tips when in use. A further feature of the configuration depicted is that it provides progressively increasing functional efficiency when the device 10 is pulled in a wiping action backwards over a wet and/or soiled surface whilst positioned so that edge 18 of the device is the leading edge.

The materials from which the layers 13 and 14 are formed are preferably identical and the device preferably has an axis of symmetry. In this way, the device is equally effective when used by left handed or right handed people and cleaning and drying efficiency is not affected by the surface selected to contact the body.

The layers 13 and 14 are preferably formed from hydro-entangled webs in which the fibres are preferably 100% cellulose fibres thus permitting the device 10 to be disposed of through conventional sewerage disposal systems such as municipal sewers and conventional domestic septic tank installations. If necessary for mechanical purposes, small amounts of synthetic fibre (up to about 8 to 9%) may be included without detracting from the ability of the devices to be flushed. It is believed that suitable coverage, security and absorbency can be achieved using layers 13 and 14 formed from bio-degradable web material having a base weight falling in the range 15 to 70 grams per square meter (gsm) and, more preferably, about 45 gsm.

The materials selected, and the manner of their combination, is preferably such as to provide total water absorbency (TWA) measures falling in the range 250 to 400 $g/m^2$ and 1000 to 2500 $g/m^2$ for the first and second zones respectively. Tensile strength in the machine direction (MDT) for the composite device preferably falls in the range 300 to 1500 g whilst the tensile failure loading in the cross machine direction (CDT) (dry) preferably falls in the range 150 to 1000 g.

The absorbency and failure load measures recited in the preceding paragraph are all derived using standard PIRA paper testing procedures.

Notwithstanding the quantitative measures given above, material selection for layers 13 and 14 is not regarded as critical to the performance of the invention and those skilled in paper making art and technology will readily appreciate that materials may be selected to give different degrees of total absorbency, tensile strength, strike-through, softness, comfort, feelings of security etc.

An important feature of the invention is that the devices formed in accordance with the invention be disposable through conventional sewerage disposable systems and are, accordingly, substantially bio-degradable. Examples of suitable materials which address this requirement are wood pulp based hydro-entangled webs, air-laid tissue, conventional tissue and through-dry tissue.

In one further variation, a device according to the invention may be constructed so that the material forming the body contact surface of the second zone is arranged so that the cross-machine direction thereof is aligned with the machine direction of the material providing the first zone. Since softness is generally proportional to tensile strength, by aligning the less strong axis of the second zone with the strongest axis of the first zone, a softer working body contact section is provided on a strong base. Thus users are provided with two desirable attributes, namely softness and strength, in a unitary, ready-to-use, device.

The filler 15 is preferably a soft wood-based pulp which performs adequately when used in a density of about 0.010 to 0.016 g/ml laid evenly over the area of the second zone. Alternatively, the filler 15 may comprise one or more additional layers of absorbent material in the second zone and between the layers 13 and 14.

The functional efficiency of personal use devices referred to herein may be further enhanced by including absorbency enhancing additives, and the absorbency measures given above for the second zone envisage constructions of device which include absorbency enhancing additives, sometimes referred to as superabsorbers. Suitable forms of additive include polyhydroxlylated acrylic acids such as those manufactured and sold by Allied Colloids plc of Bradford, England under the trade mark SALSORB. If the filler 15 is a pulp, such additives may be milled into, or otherwise dispersed throughout the pulp, as shown by 16 in FIG. 3, to enhance the absorbency thereof and to retain the collected waste within the device. Experimentation suggests that about 0.1 g of SALSORB spread evenly over the area of filler 15 provides very good performance and it is believed extremely good performance can be achieved using a filler density in the range specified above, combined with a SALSORB area density in the range 5 to 9 g/sq. m. If the filler 15 comprises one or more additional layers of material, the absorbency boosting agents may be impregnated into the additional material or otherwise be formed into a separate web, the principal function of which is to provide superabsorbent properties to the device.

The absorbency additives may be dispersed substantially evenly throughout the second zone or may be situated in predetermined paths or patches to provide an element of control over the take-up of faeces, urine and/or menses into the device.

Materials providing the layers 13 and 14 may also be selected, in part, for their softness or other measures of comfort. In preferred devices according to the invention, these measures will be equivalent to those of existing 'luxury' toilet tissues such as, for example, those sold under the trade marks ANDREX and CHARMIN.

The materials are selected and combined in such a way as to ensure the unitary device is not only effective in cleaning and/or drying but is sufficiently workable and malleable to enable surface parts thereof to be manipulated into body cavities and crevices using the same degree of finger pressure as is used to manipulate "products" formed from layers of conventional tissue, into body cavities and crevices. Thus the pulp or other filler defining the second zone 12 must not be too thick and we have found, in experimentation, that devices in which the second zone, containing soft wood pulp of a density in the range specified above and having an uncompressed thickness of about 1.5 to 2.5 mm allows effective manipulation into body crevices using at least two fingers in side-to-side contact and preferably all four fingers in contact.

As can be seen from FIG. 2, the resulting device 10 has a similar ability to a "pad" formed from conventional tissue, to conform, at least in part, to the contours of the user's hand and to drape or fold about, and envelop, edge parts of the hand. This degree of foldabilty or flexibility allows the device to be worked into and over the areas to be cleaned in the same manner as the prior art "products" formed from conventional tissue.

Figure 4:
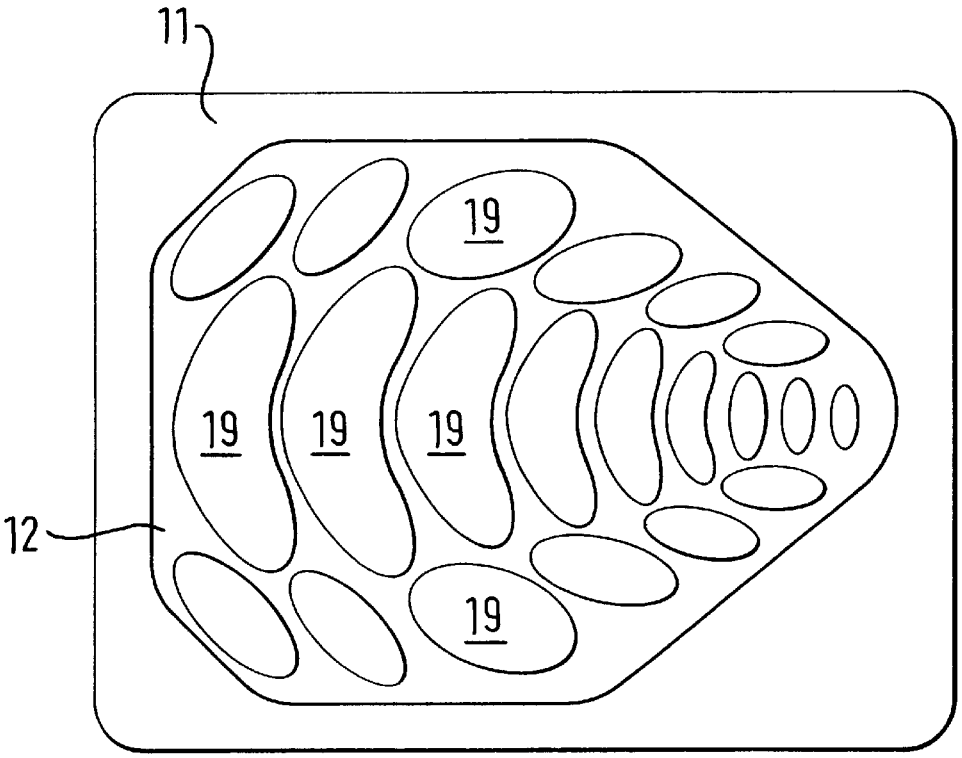
FIG. 4: shows a plan view of a variation of the personal use device shown in FIG. 1.

A variation of the basic configuration is shown in FIG. 4. In this variation the second zone 12 includes a multiplicity of visually distinctive sub-zones 19 to enhance the function of the device. The sub-zones 19 may be achieved by embossing and/or by positioning discrete patches of absorbency boosting agent as described above. In the latter event, the discrete patches may be formed in any suitable manner including by a printing-type process. The consequence is that the device is believed to have greater cleaning efficiency as it is moved over the area to be cleaned or dried. If the areas 19 are embossed, the user may also perceive greater softness.

The combination of the easily manipulable sheet materials 13 and 14, and the absorbent filler 15 provides a non-homogeneous device which ensures the most functionally effective part of the device is not only visually distinguished, but that the device is configured in an optimum form to fulfil the intended function whilst using minimal material and being disposable through conventional toilet sewerage systems.

The device 10 may further include agents such as, for example, cleansing agents, moisturising agents, deodorants and perfumes impregnated in one or both of the layers 11 and 12. Still further, devices as described herein may be used to deliver or apply pharmaceutically active compounds to, or adjacent to, the perineal area.

Turning now to FIG. 5, one option is shown for using the device as above described, the position shown being particularly suitable for wiping after defecation.

As can be seen, the device 10 is grasped by inserting part of edge 19 between thumb and forefinger and so that second zone 12 overlies the finger tips as well as a substantial part of the palm. In this way, the first zone protects the hand against contact with body effluents whilst the second zone can be worked into body crevices using the finger tips and its superior mechanical properties applied to perform the bulk of the cleaning and/or drying function.

Figure 6:
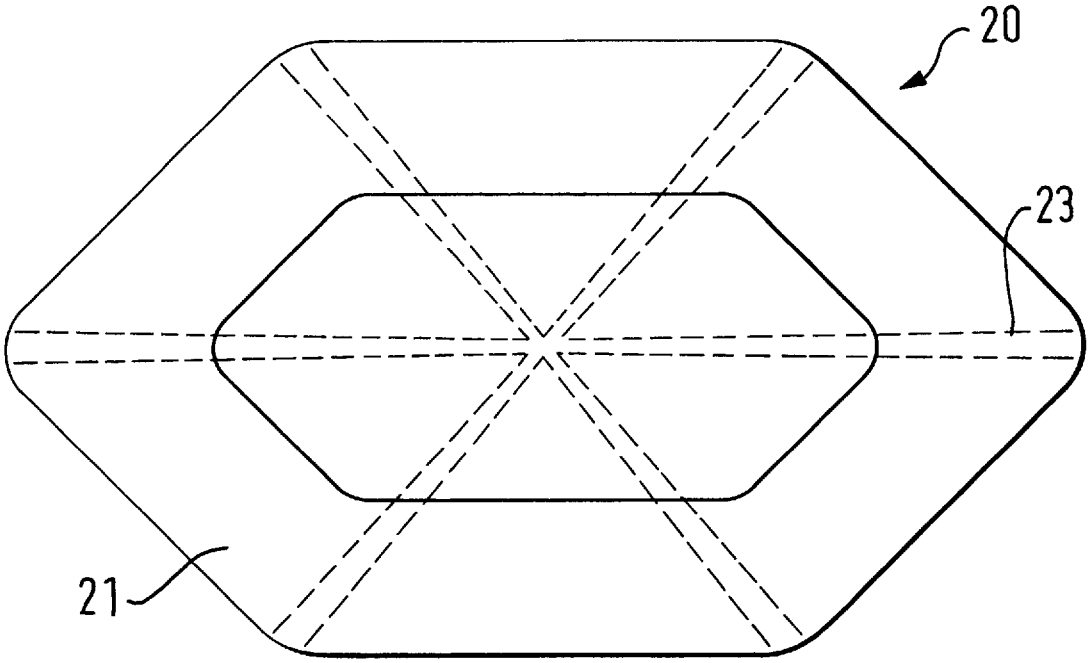
FIG. 6: shows a plan view of a further embodiment of personal use device according to the invention, but in a smaller scale than that the devices shown in FIGS. 1 to 4.
Figure 7:
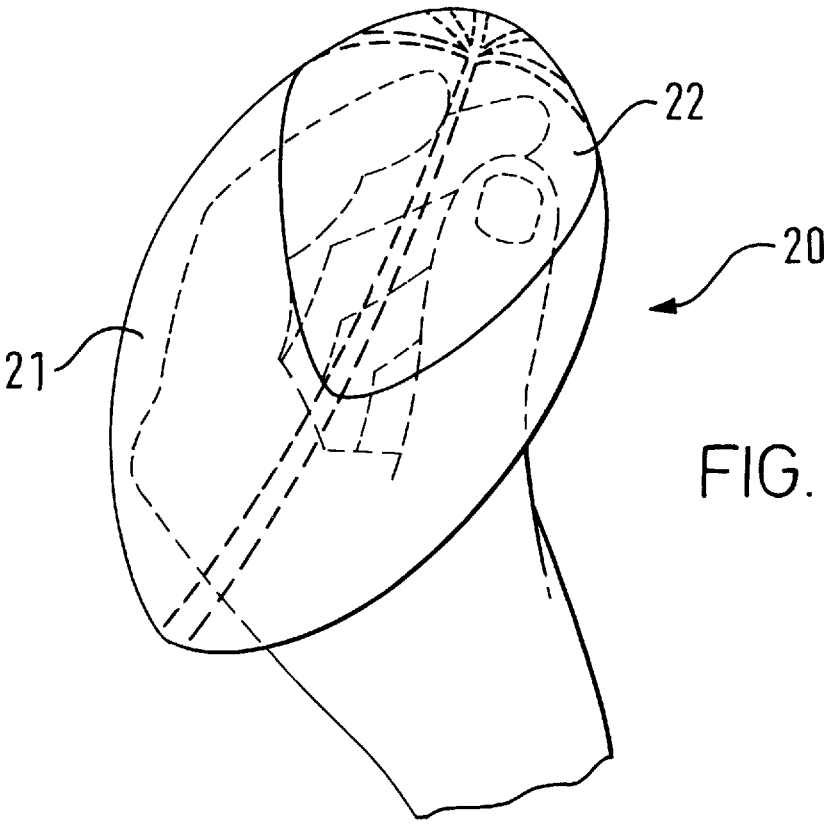
FIG. 7: shows a schematic view of the device shown in FIG. 6 supported by a user in a position ready for use.

Referring now to FIGS. 6 & 7, a further form of device 20 is shown having a first zone 21 and second zone 22. These zones may be formed as above described and the second zone may be formed with discrete absorbency patches or embossing as shown in FIG. 4. The principal difference is that the first zone 11 is considerably larger, not only than that of the devices shown in FIGS. 1 to 4, but also than the second zone 22. This allows the device to drape over considerably more of the hand, as is apparent from FIG. 7, thus considerably enhancing the hand protection afforded by the device. Further, the device 20, when supported on the finger tips, can be dabbed into contact with body surfaces and cavities.

The device shown in FIG. 6 preferably has a longest dimension, between apices, of about 230 mm and an orthogonal dimension of about 190 mm.

Material specifications can be the same for the device 20 as for the device 10. If necessary or desirable, pleats 23 may be formed from some or all of the apices of the device 20 into the geometric centre thereof. Such pleats give the device 20 a slight cone shape when viewed edge-on and assist the device 20 to form around the hand when positioned ready for use.

It will thus be appreciated that the present invention provides a number of simple yet highly effective and efficient unitary devices for cleaning and drying after human bodily functions have taken place.

EXAMPLES

A device substantially in the form shown in FIG. 1, but with a rectangular second zone measuring 90 mm by 130 m, was made from a variety of materials and tested for performance. Details were as follows:

In Example 1, layers 13 and 14 were formed from two through-dry sheets having a combined base weight of 37 gsm. Soft wood pulp was inserted between parts of the two sheets, in a density of 0.016 g/ml to define the second zone 12. 0.1 g of SALSORB was evenly dispersed over the area occupied by the wood pulp. The uncompressed thickness of the second zone was about 2.5 mm.

In Example 2, layers 13 and 14 were formed from sheets of hydro-entangled web material of base weight 46 gsm. The parameters were otherwise in accordance with Example 1.

The composite devices were then subjected to a variety of standard PIRA tests, the results of which fall in the ranges shown over.

Strike-through was measured by placing a container having a perforated base onto the second zone. The container exerted a downwards pressure on the second zone of 10 pascals (0.4 g/sq.cm).

10 mls of saline solution were deposited into the container in 2 seconds whereupon the solution passed through the perforations and into the device. The presence of saline solution on the underside of the device, i.e. after strike-through, was detected by measuring electrical conductivity across electrodes on the plate supporting the device.

The time difference between depositing the saline solution in the reservoir and detecting conductivity at the base plate was taken as a measure of strike through.

Strike through measures obtained as above were compared with those derived from applying the same procedure to layers of two-ply "luxury" toilet tissue. Results indicate that a device of the configuration described in Example 2 has equivalent strike-through performance to 32 sheets of 2-ply tissue.

| Measure | Example 1 | | Conventional | Example 2 | |
|---|---|---|---|---|---|
| | Zone 2 | Zone 1 | | Zone 2 | Zone 1 |
| TWA [gm/m$^2$] | 1000–2500 | 300–400 | 150–250 | 1000–2500 | 250–350 |
| TWA [gm/gm] | 15–30 | 50–8.5 | 4.5–7.5 | 15–30 | 5.0–8.0 |
| Strike-through [secs] | 7–8 | 0.18–0.26 | 0.1–0.2 | 7–8 | 0.2–0.3 |
| MDT Dry [gms] | 300–650 | 300–650 | 300–900 | 750–1500 | 750–1500 |
| CDT Dry [gms] | 250–350 | 150–300 | 150–250 | 400–1000 | 400–1000 |
| CDT Wet [gms] | 60–100 | 20–35 | 15–25 | 200–300 | 100–150 |
| Thickness [as used in mm] | 1.5–2.5 | 1.2–1.7 | 0.9–1.8 | 1.8–2.7 | 1.2–2.0 |

What is claimed is:

1. A unitary device for cleaning and/or drying after defecation or urination, or cleaning during menstruation, said device including:

(I) a pair of absorbent outer plies defining, at least in part, a first zone of an area sufficient in size to overlie the fingers of an intended user;

(ii) a second zone of an area less than that of said first zone, and defined, at least in part, by material of a different composition to that of said outer plies, held between said outer plies; said second zone being visually distinguishable on both of said outer plies and being sized and arranged in relation to said first zone so as to be positionable to overlie the tips of at least two fingers whilst said first zone overlies all fingers, said second zone having a higher quantitative measure than said first zone in respect of at least one of the following:
absorbency,
tensile strength,
thickness,
strike through.

2. A method of personal cleaning and/or drying after defecation, urination, or cleaning during menstruation, said method including the steps of:

(I) taking a cleaning device as claimed in claim 1;

(ii) placing said device on the hand so as to overlie the fingers when positioned in edge to edge contact;

(iii) bringing said device, positioned on the hand, into contact with a body so that said second zone primarily contacts that part of the body from which feces, urine and/or menses is to be removed;

(iv) displacing said device with respect to the body whilst maintaining contact with the body; and (v) disposing of the used device through a conventional sewerage disposal system.

3. A device as claimed in claim 1 wherein said second zone has higher measures than said first zone in respect of at least two of the parameters identified in claim 1.

4. A device as claimed in claim 1 wherein said second zone has higher measures than said first zone in respect of three or more of the parameters identified in claim 1.

5. A device as claimed in claim 1 wherein said device is comprised of materials disposable through conventional sewerage disposal systems.

6. A device as claimed claim 1 configured and sized for gripping by the application of thumb pressure when said second zone is positioned to overlie the tips of at least two fingers.

7. A device as claimed in claim 6 wherein said first zone is sized and configured to provide a gripping location.

8. A device as claimed in claim 1 wherein said first zone is sized to overlie not only the fingers but also to overlie at least part of the user's palm.

9. A device as claimed in claim 1 wherein said second zone is sized to overlie the tips of all fingers when said fingers are positioned in edge to edge contact with one another.

10. A device as claimed in claim 1 wherein said second zone is defined at least in part, by inserting wood based pulp between said outer plies.

11. A device as claimed in claim 1 wherein said second zone further includes absorbency boosting agents to enhance the absorbency thereof.

12. A device as claimed in claim 11 wherein said absorbency boosting agents are dispersed through the material held between said outer plies.

13. A device as claimed in claim 1 constructed and arranged to drape over the tips of the fingers when supported horizontally, in the position of use, on a hand.

14. A device as claimed in claim 1 wherein said outer plies are formed from materials selected from the range of hydro-entangled webs, air-laid tissue, conventional tissue and through-dry tissue, all such materials being of a composition capable of disposal through conventional sewerage disposal systems.

* * * * *